US005562461A

United States Patent [19]

Obara et al.

[11] Patent Number: 5,562,461

[45] Date of Patent: Oct. 8, 1996

[54] CIRCUIT BOARD ELECTRICAL CONNECTOR

[75] Inventors: Shu Obara; Satoshi Mori, both of Tokyo, Japan

[73] Assignee: Hirose Electric Co., Ltd., Tokyo, Japan

[21] Appl. No.: 331,091

[22] Filed: Oct. 28, 1994

[30] Foreign Application Priority Data

Jan. 11, 1994 [JP] Japan ..... 6-012248

[51] Int. Cl.[6] ..... H01R 9/09

[52] U.S. Cl. ..... 439/62; 439/326; 439/637; 439/60

[58] Field of Search ..... 439/59, 62, 60, 439/326–327, 636–637, 65, 404, 405

[56] References Cited

U.S. PATENT DOCUMENTS

| | | | |
|---|---|---|---|
| 4,373,764 | 2/1983 | Ulrich | 439/327 |
| 4,420,211 | 12/1983 | Ledbetter | 439/408 |
| 4,773,876 | 9/1988 | Nakamura et al. | 439/417 |
| 4,913,660 | 4/1990 | Hirai | 439/396 |
| 4,941,830 | 7/1990 | Tkazyik et al. | 439/59 |
| 4,995,828 | 2/1991 | Goodman et al. | 439/405 |
| 5,156,553 | 10/1992 | Katsumata et al. | 439/62 |
| 5,281,152 | 1/1994 | Takahashi et al. | 439/79 |
| 5,316,486 | 5/1994 | Tanaka et al. | 439/62 |

FOREIGN PATENT DOCUMENTS

| | | | |
|---|---|---|---|
| 197623 | 10/1986 | European Pat. Off. . | |
| 244192 | 11/1987 | European Pat. Off. . | |
| 0421474 | 4/1991 | European Pat. Off. | 439/62 |

*Primary Examiner*—David L. Pirlot
*Assistant Examiner*—Jill Demello
*Attorney, Agent, or Firm*—Kanesaka & Takeuchi

[57] ABSTRACT

A circuit board electrical connector which includes a first connector (10) connectable to a first external member (Q) and a second connector (30) connectable to the first connector at one end and a second external member at the other end opposite to the one end. The first connector includes an insulation block (11) with a connection recess (12) having an opening on a front side thereof; a plurality of first contact elements (20, 21) disposed within the insulation block such that contact portions are exposed in the connection recess. The second connector includes a contact support (38); a connection section (31) connected to the contact support at one end and to be inserted into the connection recess on the other end opposite to the one end; a plurality of second contact elements (33–36) having contact portions (33A–36A) disposed on the connection section for spring contact with the first contact elements and connection portions (33B–36B) extending through the contact support for connection with the second external member; an arrangement pitch of the contact portions of the second contact elements being different from that of the connection portions of the second contact elements.

8 Claims, 4 Drawing Sheets

CIRCUIT BOARD ELECTRICAL CONNECTOR

BACKGROUND OF THE INVENTION

1. Field of the Invention

The present invention relates generally to circuit board electrical connectors and particularly to a circuit board electrical connector which makes a so-called "pitch conversion" to thereby connect a first external member to a second external member having a contact arranging pitch different from that of the first external member.

2. Description of the Related Art

In FIG. 1, a circuit board 51 has circuit conductors on the upper surface thereof for connection to the connection portions of contact elements. An electrical connector 52 is attached to the upper surface of the circuit board 51 for receiving two cards 53 or other external members. Contact elements are arranged within the connector 52 in upper and lower planes in the direction perpendicular to the paper sheet, The contact portions of the contact elements are arranged within a housing 52A for contact with the corresponding circuit conductors of the card 53. The connection portions 54 of the contact elements project from the housing 52A.

A conversion connector 56 has a lower connector 56B connected to the circuit board 51 and an upper connector 56A connected to a conversion board 55. The other end of the conversion board 55 is coupled to the housing 52A. The upper connector 56A is connected to the lower connector 56B. Circuit conductors are formed on the both sides of the conversion board 55 to connect the corresponding connection portions 54 of the upper and lower contact elements. The arranging pitch of the connection portions 54 and the contact portions of the card 53 is different from the arranging pitch of the circuit conductors of the circuit board 51. Usually the former pitch is coarser than the latter pitch.

In operation, the lower connector 56B is soldered to the circuit board 51 while the upper connector 56A is soldered to the conversion board 55. Then, the conversion board 55 is inserted into the connector 52, and the connection portions 54 of the connector 52 are soldered to the conversion board 55. The connectors 56A and 56B are then connected to thereby connect the card 53 to the circuit board 51 even if the arrangement pitch of the card 53 is different from the arrangement pitch of the circuit board 51.

In FIGS. 2 and 3, a connector 62 is divided into two connectors 62A and 62B. A conversion board 65 is made flexible. The connection portions 64B of contact elements of the lower connector 62B are connected to a circuit board 61 directly.

As best shown in FIG. 2, the connection portions 64A of contact elements of the upper connector 62A are soldered to the conversion board 65 which is soldered to the upper connector 56A.

As best shown in FIG. 3, the lower connector 62B is mounted on the circuit board 61, and the connection portions 64B of contact elements are soldered to the circuit board 61. Then, the upper connector 56A and the lower connector 56B are connected.

Even if the arrangement pitch of contact portions of a card is different from the arrangement pitch of circuit conductors of a circuit board, it is possible to connect the card to the circuit board via the conversion connector.

However, the above electrical connector has many soldering points and suffers not only low productivity but also poor connection by soldering. Also, it needs a conversion board and increases the manufacturing cost. When poor soldering is found at the connection portion 64B of the lower connector, it is necessary to disconnect the conversion connector for repair. Especially, in the connection portion 54 in FIG. 1, the repairing operation is very difficult because the conversion board is not flexible.

Furthermore, the conversion board makes the connector larger.

SUMMARY OF THE INVENTION

Accordingly, it is an object of the invention to provide a circuit board electrical connector which is free from the above problem.

According to the invention there is provided a circuit board electrical connector which includes a first connector connectable to a first external member and a second connector connectable to the first connector at one end and a second external member at the other end opposite to the one end. The first connector includes an insulation block with a connection recess having an opening on a front side thereof; a plurality of first contact elements disposed within the insulation block such that contact portions are exposed in the connection recess. The second connector includes a contact support; a connection section connected to the contact support at one end and to be inserted into the connection recess on the other end opposite to the one end; a plurality of second contact elements having contact portions disposed on the connection section for spring contact with the first contact elements and connection portions extending through the contact support for connection with the second external member; an arrangement pitch of the contact portions of the second contact elements being different from that of the connection portions of the second contact elements.

The circuit board electrical connector according to the invention is used as follows:

(1) The first connector is mounted on the first external member, and the connection portions of contact elements of the first connector are soldered to the conductors of the external member.

(2) The connection section of the second connector is inserted into the connection recess of the first connector. Then, the second connector is turned clockwise so that the contact portions of the first contact elements make spring contact with the connection section.

(3) Then, an external member is connected to the second connector.

The above and other objects, features, and advantages of the invention will be more apparent from the following description when taken in conjunction with the accompanying drawings.

DESCRIPTION OF THE PREFERRED EMBODIMENT

Figure 1:
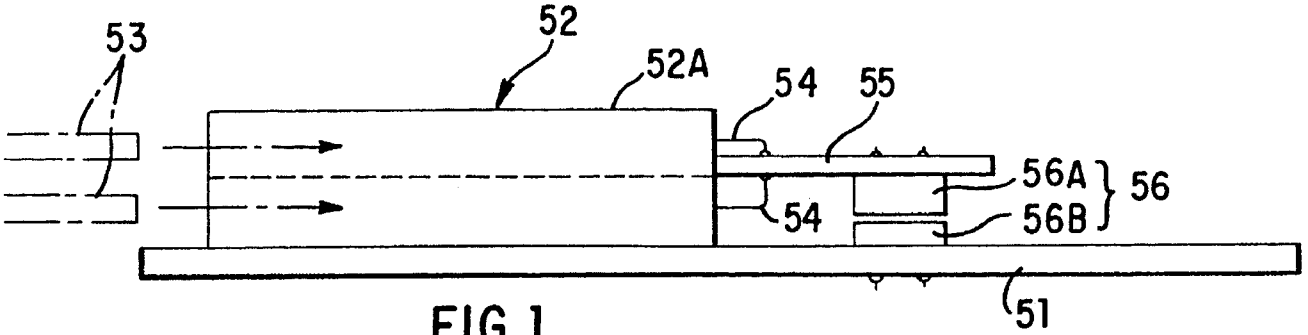
FIG.1 PRIOR ART
FIG. 1 is a side view of a circuit board electrical connector according to an embodiment of the related art.
Figure 2:
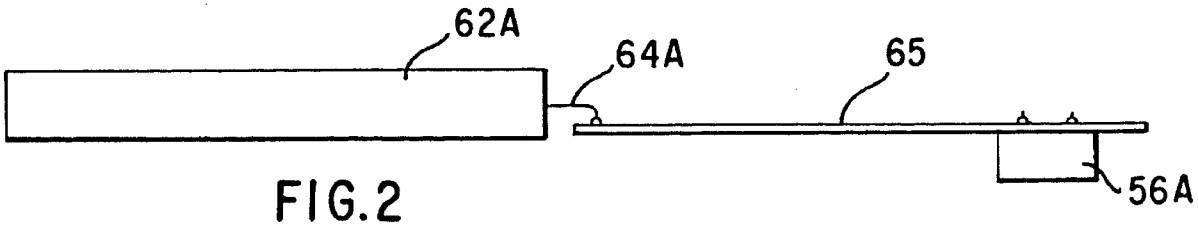
FIG.2 PRIOR ART
FIG. 2 is a side view of a circuit board electrical connector according to another embodiment of the related art.
Figure 3:
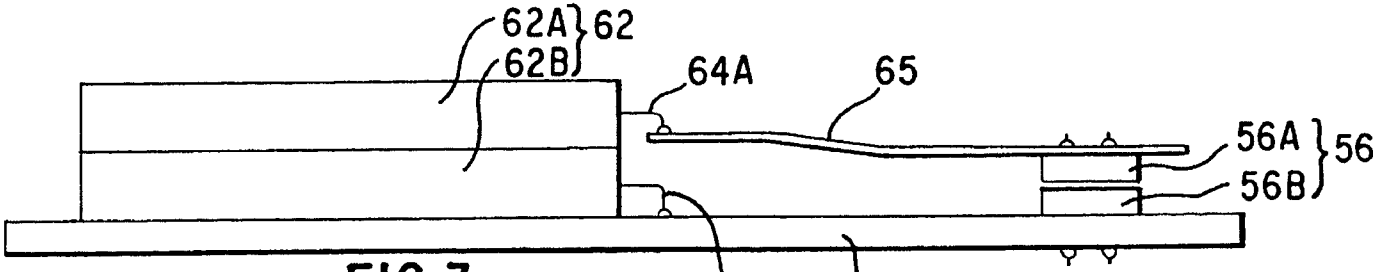
FIG.3 PRIOR ART
FIG. 3 is a side view of the circuit board electrical connector of FIG. 2.
Figure 4:
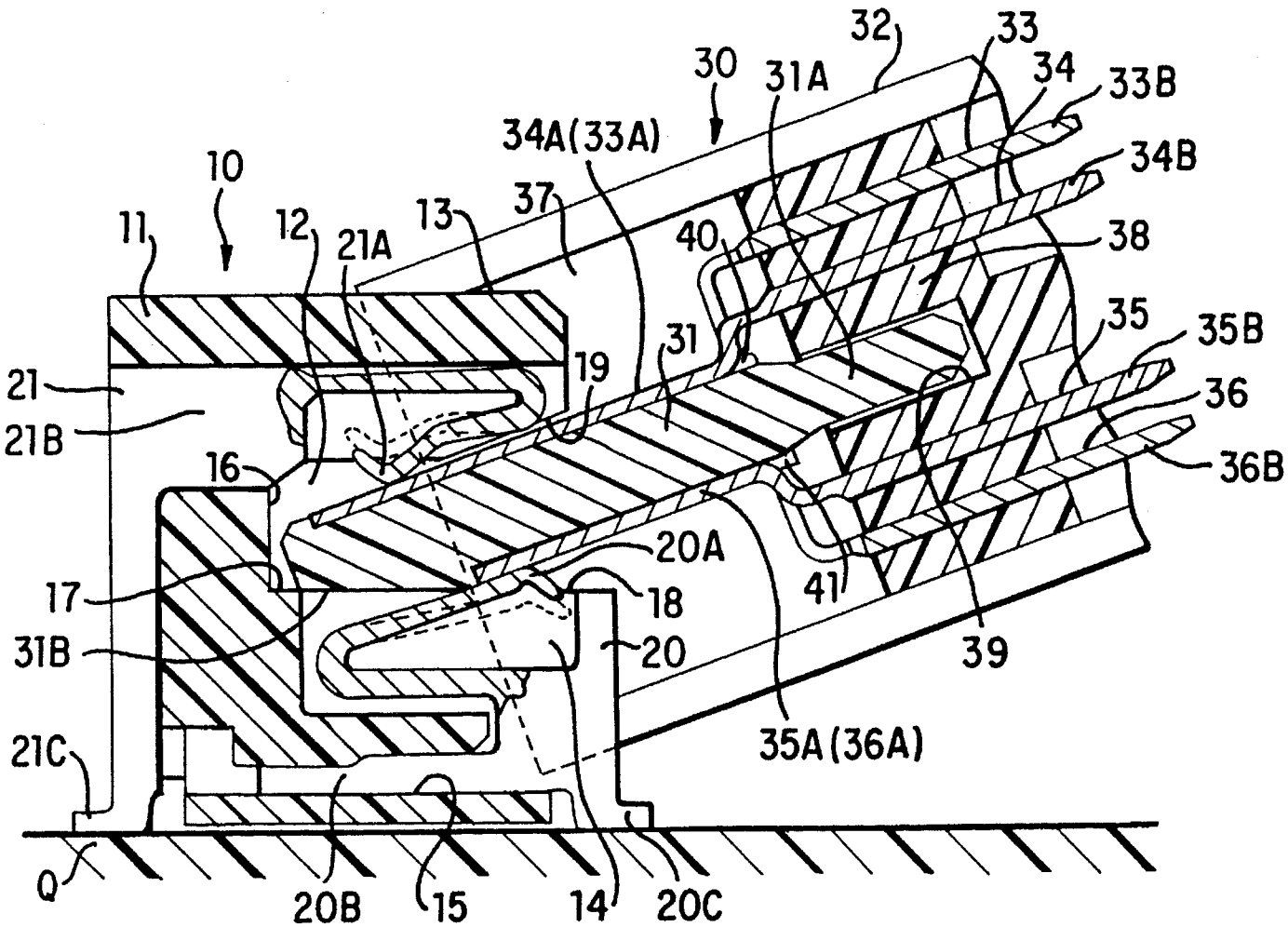
FIG. 4 is a sectional view of a circuit board electrical according to an embodiment of the invention.

In FIG. 4, a circuit board electrical connector is made up of a first connector 10 and a second connector 30.

An insulation block 11 is molded from an insulation material so as to have an elongated body with a substantially square cross section.

A connection recess 12 is formed in the insulation block 11 with an opening on the upper right side (front side) in the figure. The connection recess 12 extends in the longitudinal direction of the insulation block 11. Contact channels 13 and 14 are formed at regular pitch in the longitudinal direction in the upper and lower walls of the connection recess 12 for receiving contact elements. The upper channels 13 communicate with the connection recess 12 on the front side and are opened on the rear side. The lower channels 14 are opened on the front side and communicate with engaging channels 15 which are formed in parallel to the lower channels 14.

The connection recess 12 has a stop surface or rear wall 16 which determines how far the second connector 30 is inserted and a guide surface or bottom surface 17 which extends forwardly from the stop surface 16. A control surface 18 is formed in the same plane as the guide surface 17 to control the turning angle of the connection section 31 of the second connector 30.

A tapered insertion guiding surface 19 is formed on the upper edge of the connection recess 12 to facilitate the insertion of the connection section 31. If there is no insertion guiding surface, it is necessary to enlarge the connector so that the height of the connection recess 12 is sufficiently large to receive the connection section 31 in an inclined direction as shown in FIG. 4.

Lower contact elements 20 are inserted into the contact channels 14 from the front side. The contact elements 20 are made by stamping from sheet metal so as to provide a contact portion 20A which makes a spring contact with the connection section 31, an engaging portion 20B which is press fitted into the engaging channel 15, and a connection portion 20C which projects from the bottom surface of the insulation block 11. The lower contact elements 20 are arranged side by side with a pitch p.

Similarly, the upper contact elements 21 are made by stamping sheet metal and arranged side by side with the pitch p in the same planes as the lower contact elements 20. The upper contact elements 21 have a spring contact portion 21A which are bent in the direction opposite to that of the lower contact elements 20, an engaging portion 21B engaging with the rear opening of the housing, and a connection portion 21C which projects from the bottom of the insulation block 11.

In FIG. 4, the distance between the contact portions 20A of the lower contact elements 20 and the contact portions 21A of the upper contact elements 21 in the direction perpendicular to the direction of insertion is made substantially equal to the thickness of the connection section 31.

Preferably, fixing legs extend downwardly from the bottom of the insulation block 11 to be inserted into the fixing holes of the circuit board Q for positioning and securing the insulation block 11 on the board Q.

The second connector 30 to be fitted into the first connector 10 is molded from an insulation material. Upper contact elements 33 and 34 and lower contact elements 35 and 36 are disposed within the casing 32 which supports the connection section 31 made from an insulation material. The contact elements 33–36 are made from a conductive metal.

The casing 32 is made from an insulation material so as to have a pair of side walls 37 on opposite sides for guiding the insertion into the first connector 10. A contact element support 38 is flanked by the side walls 37 in the middle of the casing 32.

A receiving recess 39 extends laterally in the front portion of the contact element support 38 for receiving the rear portion 31A of the connection section 31. The connection section 31 may be either press fitted or inserted with a certain play into the receiving recess 39.

The connection section 31 is made from an insulation material so as to have an inclined surface 31B on the lower front end and, on the upper and lower surfaces, grooves 40 and 41 arranged with the pitch p for receiving the contact portions 33A, 34A, 35A, and 36A of contact elements 33, 34, 35, and 36.

The upper contact elements 33 and 34 and the lower contact elements 35 and 36 are supported by the contact support 38 in two horizontal planes, respectively, in the upper and lower sections of the contact support 38. The contact elements 33–36 have a contact portion 33A, 34A, 35A, and 36A on the front side and a connection portion 33B, 34B, 35B, and 36B on the rear side for connection with external members.

Figure 5:
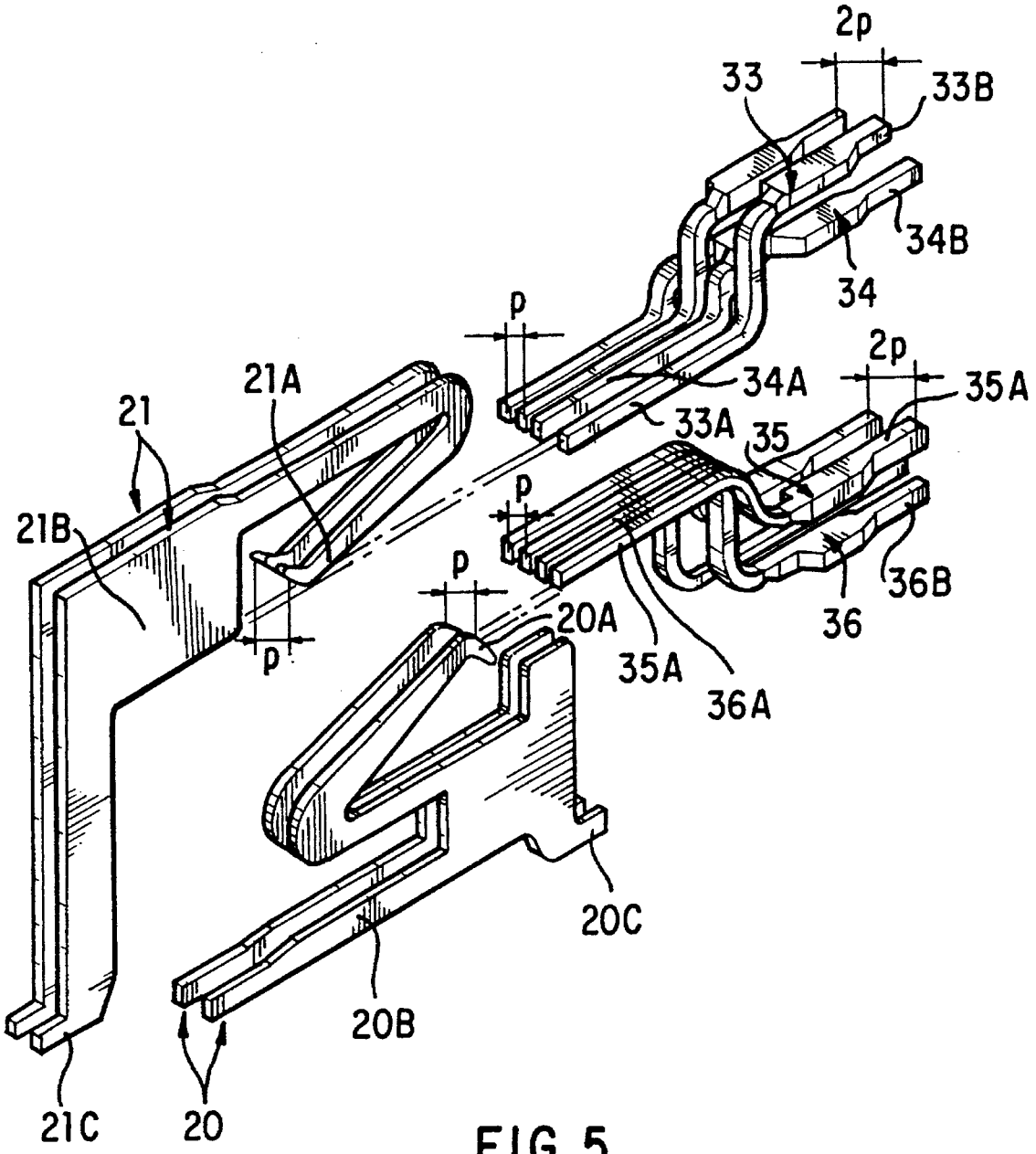
FIG. 5 is a perspective view of contact elements for the circuit board electrical connector.

In FIG. 5, the connection portions 33B of the upper contact elements 33 are offset by a half pitch p/2 with respect to the contact portions 33A, while the connection portions 34B of the other upper contact elements 34 are offset by a half pitch p/2 with respect to the connection portions 34A in the direction opposite to that of the contact elements 33. Consequently, the contact portions 33A and 34A of the contact elements 33 and 34 are offset by one pitch p while the connection portions 33B and 34B are in the same vertical plane. Thus, pitch conversion is made wherein the connection portions 33B and 34B are arranged with twice the pitch or 2p while the contact portions 33A and 34A are arranged with the same pitch p as the upper contact elements 21 of the first connector 10.

Similarly, the lower contact elements 35 and 36 of the second connector undergo the pitch conversion as shown in FIG. 5.

The connector according to the invention is used as follows:

(1) As shown in FIG. 4, the first connector 10 is disposed at a predetermined position on the circuit board Q so that the fixing legs of the first connector 10 are inserted in the fixing holes of the circuit board Q for positioning. As a result, the connection portions 21C and 20C of the upper and lower contact elements 21 and 20 are brought into contact with the corresponding circuit conductors on the circuit board Q. Under these conditions, soldering is made between the connection portions 21C and 20C and the corresponding conductors of the circuit board Q.

(2) The connection section 31 of the second connector 30 is inserted into the connection recess 12 of the first connector 10 such that the it is guided by the insertion guiding surface 19 with no or little contact with the upper and lower contact elements 21 and 20. The inclined surface 31B of the connection section 31 slides on the guiding surface 17, and the front end abuts against the stop surface 16.

Figure 6:
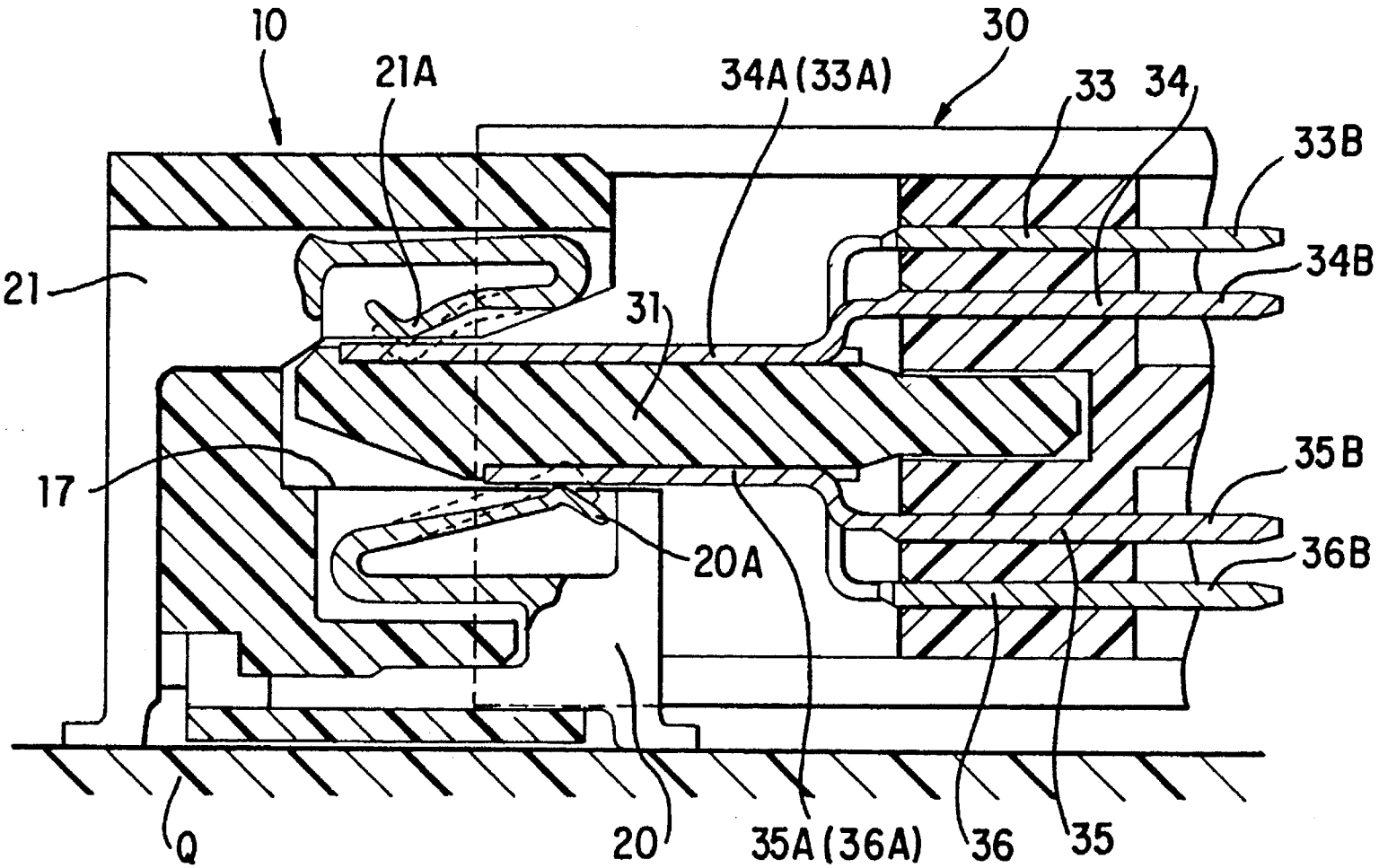
FIG. 6 is a sectional view of the circuit board electrical connector, wherein connection is completed.

(3) As shown in FIG. 6, the second connector 30 is turned clockwise to the horizontal position wherein the connection section 31 engages a lock of the connector insulation block 11. Thus, the contact portions 33A, 34A, 35A, and 36A of the second connector 30 are brought into spring contact with the contact portions 20A and 21A of the first connector 10. At the end of turning operation, the connection section 31 abuts against the control surface 18 so that the contact elements 20 and 21 are protected from damage or plastic deformation because of excessive forces.

(4) A card, connector, or cable is then connected to the connection portions 33B–36B of the second connector 30. Thus, the external member is electrically connected to the circuit board with the pitch conversion.

Alternatively, the connection section and the contact support may be molded integrally.

According to the invention, it is possible to connect the first connector, which is connected to the circuit board, to the second connector for receiving an external member, thus eliminating a conversion board with many soldering points, increasing the reliability and reducing the manufacturing cost, and making the connector compact.

We claim:

1. A circuit board electrical connector comprising a first connector mountable on a first external member and a second connector connectable to said first connector at a front end and to a second external member at a rear end opposite to said front end, said first connector comprising:

an insulation block with a substantially rectangular cross section having front, rear, top, and bottom faces;

a connection recess extending rearwardly from said front face for receiving said second connector at an angle and then holding it at right angles with respect to said front face;

a plurality of first contact elements disposed within said insulation block such that contact portions are exposed in said connection recess; and said second connector comprising:

connection means having a front portion to be inserted into said connection recess; and a plurality of second contact elements having front contact portion disposed on said connection means for spring contact with said first contact elements and rear contact portions extending rearwardly from said front contact portions for contact with contact elements of said second external member, wherein said connection means of said second connector is removable from said contact support and has a plurality of grooves for receiving said contact portions of said second contact elements.

2. A circuit board electrical connector according to claim 1, wherein said connection means comprises an inclined surface on a lower front end portion thereof.

3. A circuit board electrical connector according to claim 1, wherein said connection recess of said first connector comprises a guiding surface on a bottom thereof for guiding said connection section of said second connector.

4. A circuit board electrical connector according to claim 3, wherein said connection recess of said first connector comprises a control surface provided substantially in the same plane as said guiding surface for controlling excessive turning forces of said second connector.

5. A circuit board electrical connector according to claim 1, wherein said insulation block is provided with an insertion guiding surface on an upper edge of said connection recess.

6. A circuit board electrical connector according to claim 2, wherein said rear contact portions of said second contact elements have an arrangement pitch twice as large as an arrangement pitch of said front contact portions of said second contact elements.

7. A circuit board electrical connector according to claim 1, wherein said rear contact portions of said second contact elements have an arrangement pitch twice as large as an arrangement pitch of said front contact portions of said second contact elements.

8. A circuit board electrical connector comprising:

a first connector mountable on a first external member and a second connector connectable to said first connector at a front end and to a second external member at a rear end opposite to said front end, said first connector comprising:

an insulation block with a substantially rectangular cross section having front, rear, top, and bottom faces;

a connection recess extending rearwardly from said front face for receiving said second connector at an angle and then holding it at right angles with respect to said front face;

a plurality of first contact elements disposed within said insulation block such that contact portions are exposed in said connection recess; and said second connector comprising:

connection means having a front portion to be inserted into said connection recess; and a plurality of second contact elements having front contact portions disposed on said connection means for spring contact with said first contact elements and rear contact portions extending rearwardly from said front contact portions for contact with contact elements of said second external member, wherein said connection means comprises a contact support and a connection section having a rear end removably connected to said contact support.

* * * * *